US006817953B2

(12) United States Patent
Farmer

(10) Patent No.: US 6,817,953 B2
(45) Date of Patent: Nov. 16, 2004

(54) PUTTER GOLF CLUB WITH ALIGNMENT FEATURES

(76) Inventor: David Martin Farmer, 910 N. Delaware, Roswell, NM (US) 88201

( * ) Notice: Subject to any disclaimer, the term of this patent is extended or adjusted under 35 U.S.C. 154(b) by 0 days.

(21) Appl. No.: 09/968,375

(22) Filed: Oct. 1, 2001

(65) Prior Publication Data

US 2002/0103038 A1 Aug. 1, 2002

Related U.S. Application Data

(60) Provisional application No. 60/237,461, filed on Oct. 2, 2000.

(51) Int. Cl.[7] ..... A63B 53/04
(52) U.S. Cl. ..... 473/251
(58) Field of Search ..... 473/254, 340, 473/341, 350, 251, 313, 252, 253

(56) References Cited

U.S. PATENT DOCUMENTS 3,578,332 A * 5/1971 Caldwell ..... 473/249
3,912,274 A * 10/1975 Brace ..... 473/253
4,343,472 A * 8/1982 Hamilton ..... 473/240
4,722,528 A * 2/1988 Tsao ..... 473/254
4,913,438 A * 4/1990 Anderson ..... 473/253
5,226,654 A * 7/1993 Solheim ..... 473/313
5,267,733 A * 12/1993 Szokola ..... 473/313
5,816,930 A * 10/1998 Brown ..... 473/254
5,913,731 A * 6/1999 Westerman ..... 473/251

* cited by examiner

*Primary Examiner*—Glenn Caldarola
*Assistant Examiner*—Tom P Duong

(57) ABSTRACT

A putter golf club with alignment features includes a handle shaft, a hosel connected to the handle shaft, and a head connected to the hosel. The head includes a front blade which includes a blade back surface which extends vertically in a first vertical plane. A pair of obliquely intersecting upper surfaces, intersecting at a body peak, are located behind the blade back surface and have a vertical height lower than the blade back surface. A body step face is located behind a portion of the upper surface at a predetermined distance away from the blade back surface. The body step face extends vertically in a second vertical plane. The first vertical plane and the second vertical plane is parallel to each other. The predetermined distance between the blade back surface and the body step face define an alignment region. Preferably, the hosel includes planar sides that are aligned with the first and second vertical planes.

4 Claims, 12 Drawing Sheets

FIG 6A
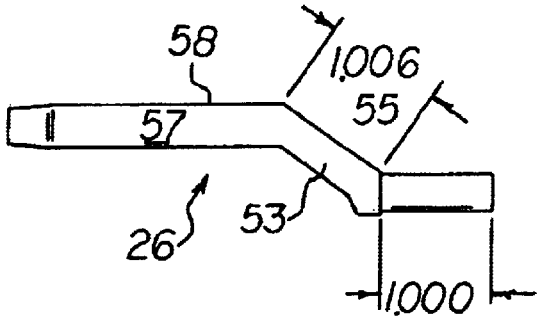
FIG 6B
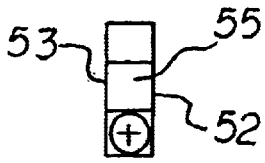
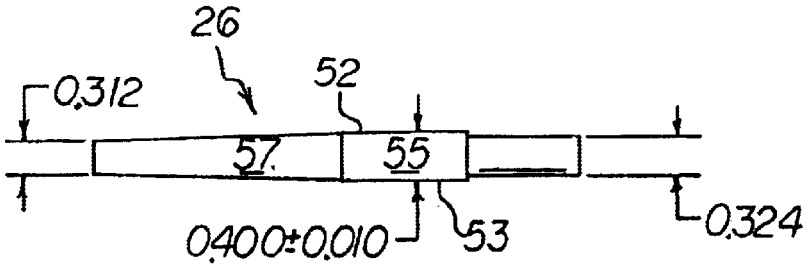
FIG 6C
FIG 7A
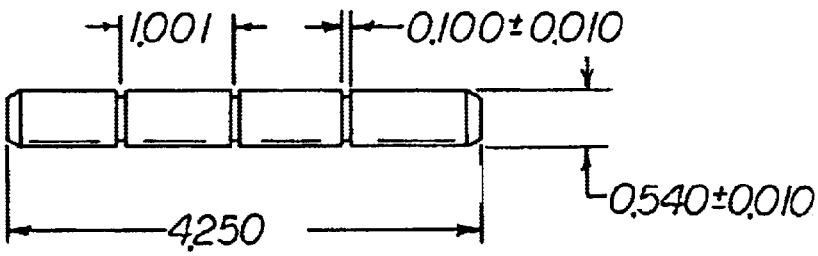
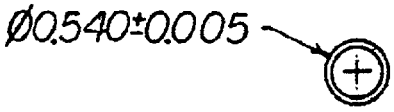
FIG 7B FIG. 11
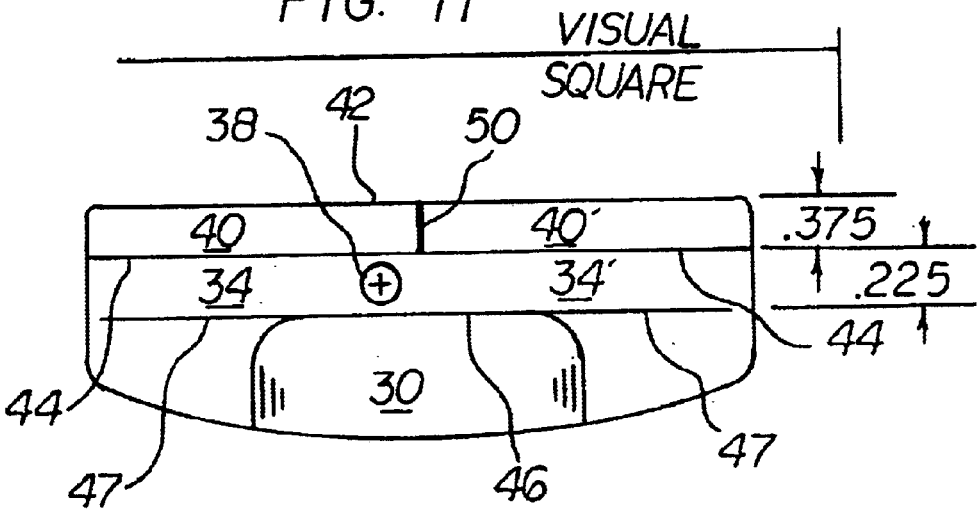
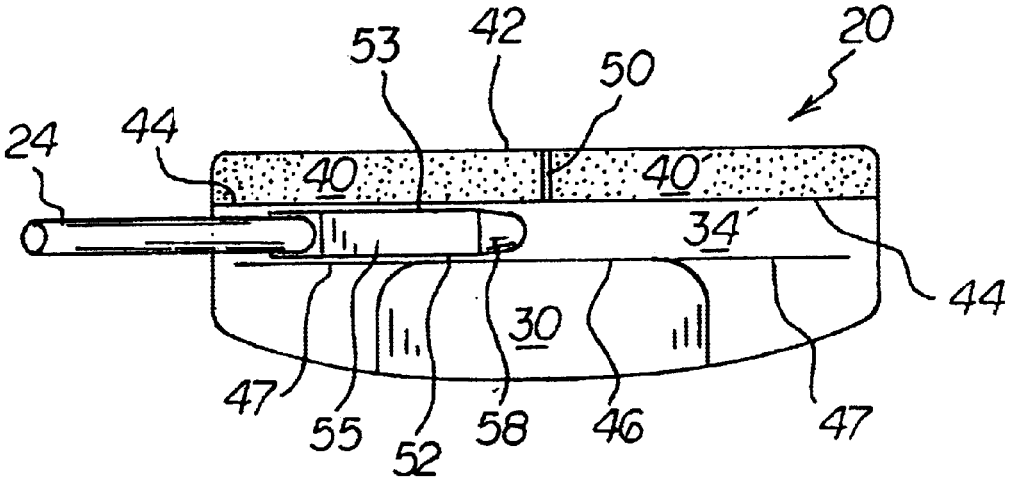
FIG. 13

FIG 12A
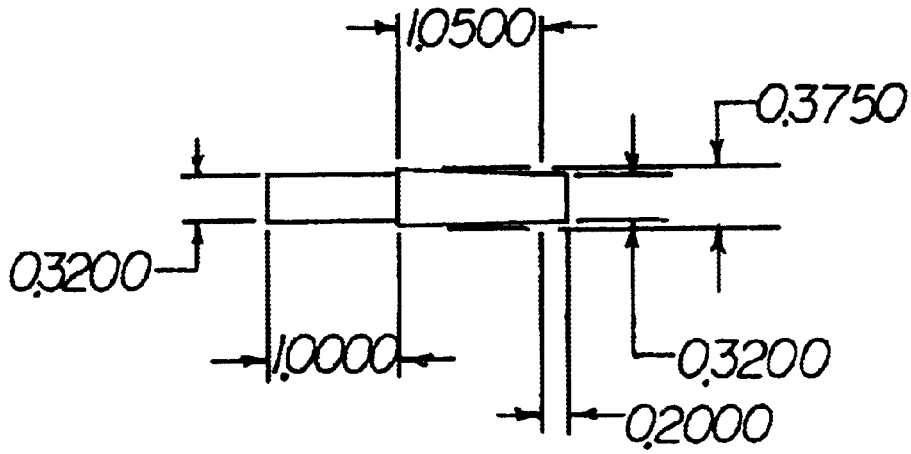
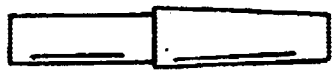
FIG 12B
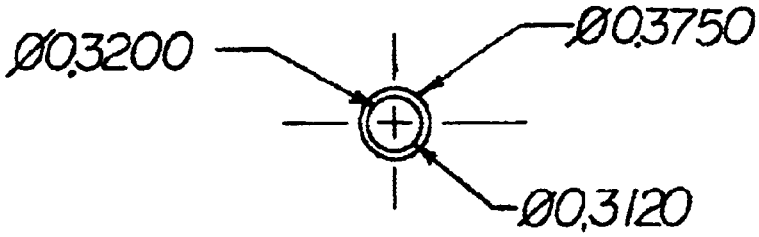
FIG 12C

PUTTER GOLF CLUB WITH ALIGNMENT FEATURES

CROSS-REFERENCE TO RELATED APPLICATION

This application claims priority based upon my copending Provisional Application Ser. No. 60/237,461, filed Oct. 2, 2000.

BACKGROUND OF THE INVENTION

1. Field of the Invention

The present invention relates to golf clubs, particularly putters, and specifically to a putter having features to assist a user in accurately aligning the club with a golf ball when putting.

2. Description of the Prior Art

Putting is an integral and critical part of the game of golf. Putting involves the use of specialized clubs to make comparatively gentle (compared to driving) but highly accurate strokes on a ball at rest upon a putting green surrounding a hole containing a cup. In putting, maximizing range is of no importance, while aiming precision is paramount. The golfer strives to align the club, assume a correct stance, and perform the stroke in a manner that will result in the ball rolling along a path to the cup. To accomplish this, the putter must be properly aligned with the ball to optimize the contact of the putter with the ball to direct the movement of the ball in precisely the direction the golfer intends the ball to go. While the force of the putting stroke is important (the golfer not wanting to undershoot or overshoot the hole), the importance of correctly aiming the direction of ball travel is paramount.

Throughout the years, various assists have been developed to aid the golfer in aiming a putt. Some elaborate electro-optical aiming systems have been devised using bubble levels, lasers, etc., but such systems have generally been rejected for being too complex, time consuming, and even in violation of the rules of the game of golf.

Commonly, currently employed visual alignment aids that are incorporated into putter designs are primarily perpendicular grooves located on top of the putter blade, or, in the case of a mallet-design putter, on the top surface of the sole. Such grooves are often highlighted by the use of white, black, red, or other contrasting colors of paint or colored inserts. The grooves, viewed in combination with the putter blade, are used to align the face of the putter with the intended path of the ball. In sum, most known alignment aids purport to inform the user when the face of the putter is perpendicular to the intended path of the ball.

However, this common aligning assist is uni-dimensional. That is, the alignment groove is viewed in the vertical (or near vertical) plane common to the blade of the putter. This uni-dimensional character of current putter aiming systems leaves ample room for aiming error. One solution that has been proposed is that used in the SeeMore(TM) putter system, which utilizes a pair of parallel white lines on the top of the putter head. When, as the user looks down the club and toward the ball, the shaft of the club is disposed precisely between the lines so that the lines are just visible on either side of the shaft alignment, the putter is ostensibly in alignment.

In addition to the known putting alignment devices mentioned above, a number of additional innovations have been developed relating to putter alignment devices, and the following U.S. patents are representative of some of those innovations: U.S. Pat. Nos. 5,544,883, 5,564,990, 5,913,731, 6,117,020, and 6,203,443. More specifically, U.S. Pat. No. 5,544,883 discloses a putter having an offset hosel. The putter has a narrow top surface which has a notch used to assist in proper alignment of the putter and a golf ball. The notch does not extend beyond the narrow top surface, so the notch does not provide an extended line for providing alignment. To improve alignment features, it would be desirable if a putter having alignment features included an extended alignment line.

U.S. Pat. No. 5,564,990 discloses a putter having alignment features which includes an extended alignment line. However, even if an alignment line of a putter is properly aligned on a golf ball, the putter may be improperly tilted. In this respect, it would be desirable if a putter having alignment features were provided which includes means for assuring that the putter is not improperly tilted when a putter is employed.

U.S. Pat. Nos. 5,913,731 and 6,203,443 disclose other putters that have extended alignment lines. However, these putters do not include means for assuring that the putter is not improperly tilted when the putter is employed.

U.S. Pat. No. 6,117,020 discloses a specific laser aiming device for a putter. It is recalled that laser aiming devices for putters are discussed hereinabove.

As a matter of interest, U.S. Pat. No. 5,364,102 discloses a golf putter that can be equipped with interchangeable weights. However, this putter does not include alignment features.

Still other features would be desirable in a putter golf club with alignment features. For example, it would be desirable if a system of interchangeable putter golf club components could be provided to accommodate a wide variety of golfers. More specifically, it would be desirable if a system employing interchangeable putter golf club handles, counterweights, hosels, and heads were provided to accommodate a wide variety of golfers, including golfers who grow up from junior golfers to senior golfers.

Thus, while the foregoing body of prior art indicates it to be well known to use putter golf clubs having alignment features, the prior art described above does not teach or suggest a putter golf club with alignment features which has the following additional combination of desirable features: (1) includes an extended alignment line; (2) includes means for assuring that the putter is not improperly tilted when a putter is employed; (3) provides a system of interchangeable putter golf club components can be used to accommodate a wide variety of golfers; and (4) provides a system which employs interchangeable putter golf club handles, counterweights, hosels, and heads to accommodate a wide variety of golfers, including golfers who grow up from junior golfers to senior golfers. The foregoing desired characteristics are provided by the unique putter golf club with alignment features of the present invention as will be made apparent from the following description thereof. Other advantages of the present invention over the prior art also will be rendered evident.

SUMMARY OF THE INVENTION

To achieve the foregoing and other advantages, the present invention, briefly described, provides a putter golf club with alignment features which allows the user to more precisely align the putter with the intended path of the golf ball, thereby enhancing putting accuracy. The invention is solely mechanical, in that the head and/or hosel of the putter is specially shaped to provide particular alignment surfaces and features which the user views during the putt. No electronic or complex optical components are employed.

Broadly described, the invention includes specially shaped putter heads and hosels that permit the user to sight down more than one reference plane, and thereby determine the proper perpendicularity of the putter blade during the putt. Thus, the shape of the apparatus offers the utilitarian function of providing a multi-dimensional alignment reference system to improve reliability of the user's aim. In one embodiment of the invention, the user manipulates the apparatus of the invention until two or more planes are not viewed obliquely, to assure that the planes are vertical and perpendicular to the intended direction of the ball movement.

Stated somewhat differently, in accordance with the invention, a putter golf club with alignment features includes a handle shaft and a head connected to the handle shaft. The head includes a front blade which includes a blade back surface which extends vertically in a first vertical plane. An upper surface is located behind the blade back surface and has a vertical height lower than the blade back surface. A body step face is located behind a portion of the upper surface at a predetermined distance away from the blade back surface. The body step face extends vertically in a second vertical plane. The first vertical plane and the second vertical plane is parallel to each other. The predetermined distance between the blade back surface and the body step face define an alignment region.

Preferably, a hosel is connected between the handle shaft and the head. Preferably, the upper surface of the head includes a pair of obliquely intersecting upper surfaces, has a vertical height lower than the blade back surface, and the body step face is located behind a portion of the obliquely intersecting upper surfaces, at a predetermined distance away from the blade back surface.

Preferably, the obliquely intersecting upper surfaces intersect at a body peak which forms an alignment line that is perpendicular to the blade back surface and the body step face. Preferably, the blade includes obliquely intersecting upper surfaces, which intersect at a aiming ridge. The aiming ridge is colinear with the body peak.

Preferably, the hosel includes a planar first hosel side which is in a third vertical plane and includes a planar second hosel side which is in a fourth vertical plane. The third vertical plane and the fourth vertical plane are parallel to the first vertical plane and the second vertical plane, and the first hosel side and the second hosel side are viewed within the alignment region when the hosel is aligned with the head. In addition, the hosel can include an offset hosel portion which is perpendicular to the first hosel side and the second hosel side. Preferably, the handle shaft includes a counterweight received in a hollow portion of the handle shaft.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a number of preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

In addition to the objects discussed above, an additional object of the present invention is to provide a new and improved putter golf club with alignment features which has all of the advantages of the prior art and none of the disadvantages.

It is another object of the present invention to provide a new and improved putter golf club with alignment features which may be easily and efficiently manufactured and marketed.

It is a further object of the present invention to provide a new and improved putter golf club with alignment features which is of durable and reliable construction.

An even further object of the present invention is to provide a new and improved putter golf club with alignment features which is susceptible of a low cost of manufacture with regard to both materials and labor, and which accordingly is then susceptible of low prices of sale to the consuming public, thereby making such putter golf club with alignment features available to the buying public.

Still yet a further object of the present invention is to provide a new and improved putter golf club with alignment features which includes an extended alignment line.

Still another object of the present invention is to provide a new and improved putter golf club with alignment features that includes means for assuring that the putter is not improperly tilted when a putter is employed.

Yet another object of the present invention is to provide a new and improved putter golf club with alignment features which provides a system of interchangeable putter golf club components can be used to accommodate a wide variety of golfers.

Even another object of the present invention is to provide a new and improved putter golf club with alignment features that provides a system which employs interchangeable putter golf club handles, counterweights, hosels, and heads to accommodate a wide variety of golfers, including golfers who grow up from junior golfers to senior golfers.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 6A is a side view of a hosel component useable with the invention.

FIG. 6B is an end or back view of the hosel shown in FIG. 6A.

FIG. 6C is a top view of the hosel shown in FIG. 6A.

FIG. 7A is a side view of a counterweight useable in a putter of the invention.

FIG. 7B is an end view of a counterweight shown in FIG. 7A.

FIG. 11 is a top plan view of the another embodiment of a putter head of the invention.

FIGS. 12A–12C are view of an alternate, lightweight hosel useable with the present invention.

FIG. 13 is a top view of a putter head, hosel, and handle shaft, depicting alignment features of the invention.

In all drawing figures, dimensions are only of an illustrative nature and are not to be regarded as limiting.

DESCRIPTIONS OF THE PREFERRED EMBODIMENTS

The present invention relates to golf putters, and particularly putter heads and hosels that assist the golfer in properly and accurately aligning and aiming the putt. The aligning system of the invention utilizes the full body of the putter, the hosel, and the shaft to define an alignment guide on a minimum of two vertical planes, and, preferably, three vertical planes.

Embodiments of the invention can include three basic models: an original first model; a lightweight second model; and a third model which is a modified first model having a lightweight heel and toe weight, and hosel placement.

The alignment guide is created by the use of parallel and perpendicular lines on three vertical planes, generally described as being an imaginary plane defined by the top face of the hosel, the raised blade of the putter, and the secondary step facet of the putter head body. The elevated leading edge on the putter blade of the invention establishes both the center of mass of the putter head body as well as the line of the face on a first vertical plane, but at a horizontal position well above the equator of a golf ball to be putted. The body of the putter defines a second vertical plane, where a non-vertical upper surface of the blade along a line well below the leading edge of the face. The blade of the putter thus defines two parallel imaginary planes.

Preferably, the system of the invention includes a component hosel system, comprised of a variety of interchangeable hosels adapted to work in conjunction with the putter body to establish third vertical and horizontal planes for use in aiming the putter. The component hosel system provides that the visual presentation of the putter at address can be customized to meet the needs of the user through the identification and incorporation in the system of a selected hosel. Individual putter and hosel components can be interchanged to achieve finished weights ranging from, for example, 300 grams to 400 grams. The hosel of the invention can be assembled to establish a "visual square" by establishing perpendicular lines on a horizontal and vertical plane above the horizontal planes of the putter head body. Offset hosels may be employed. A variety of interchangeable putter heads can also be employed. Also, a variety of interchangeable counterweights can be employed in the handle shaft.

Figure 1:
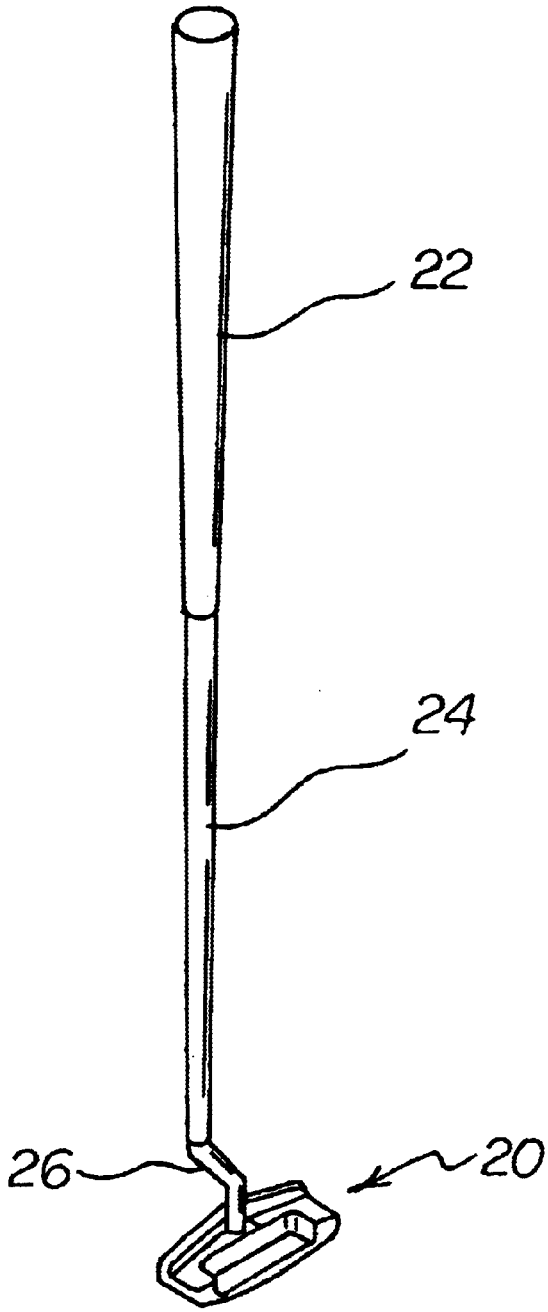
FIG. 1 is perspective view of a putter club according to the present invention.

FIG. 1 illustrates a putter in accordance with the invention. As with all putters, the apparatus of the invention includes a handle grip 22 disposed upon a shaft 24. A hosel 26 connects the shaft 24 to the head 22. As suggested in FIG. 2A, the hosel 26 preferably is mildly tapered at each end, so that the shaft 24 is inserted into the hosel 26, which in turn is inserted into a receiving hole in the head 20. A golf club may be customized, during manufacture, by selecting among various combinations of various hosels and heads preferred by the user.

Hosels and heads may be secured together using adhesives, such as conventional epoxy adhesives, or by silver soldering, or any other suitable means. For example, hosels may be attached to heads using welds. The shaft preferably is secured to the hosel with epoxy adhesive.

Figure 2A:
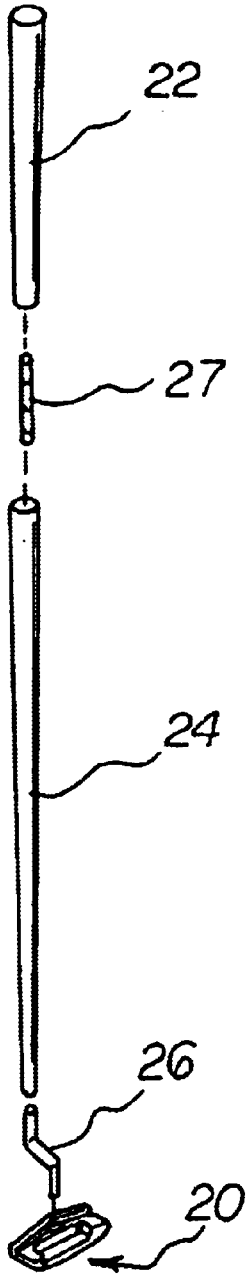
FIG. 2A is an exploded view of a putter club of the present invention.
Figure 2B:
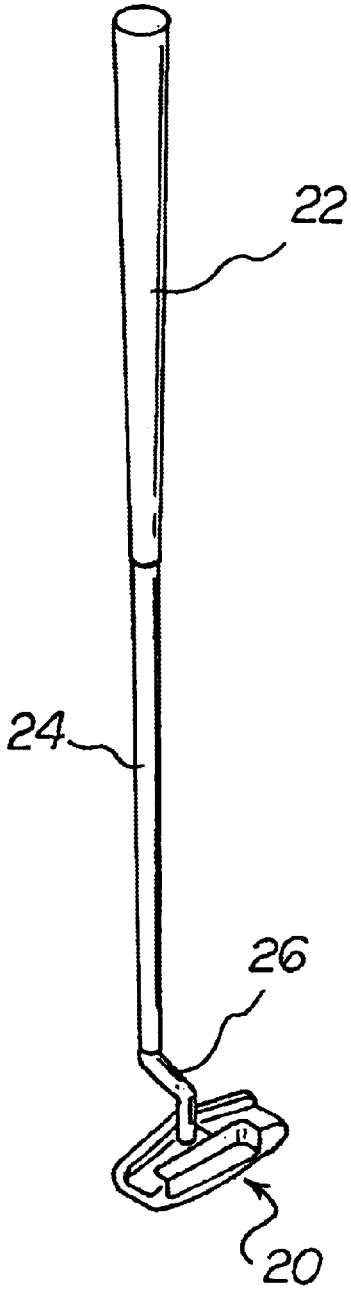
FIG. 2B is a perspective view of the club depicted in FIG. 2A, shown fully assembled.

A counterweight 27, of composition and purpose known in the art, may be disposed in the shaft 24 as shown in FIG. 2. When the various components are properly assembled, an embodiment of the invention is provided as is shown in FIG.

2B. The weights of the various components may be varied, and combined with a counterweight 27 to produce a desired "swingweight". Swingweight is a term of art, and refers to a dynamic character of a club as measured on a scale in units of A, B, C, D, and E with each unit further divided in tenths (i.e. A-1, A-2, A-3 . . . A-10). Accordingly, the invention can be customized to a user's preference, but the preferred swingweight is preserved by the incorporation of a counterweight 27, as previously known in the art.

Figure 3:
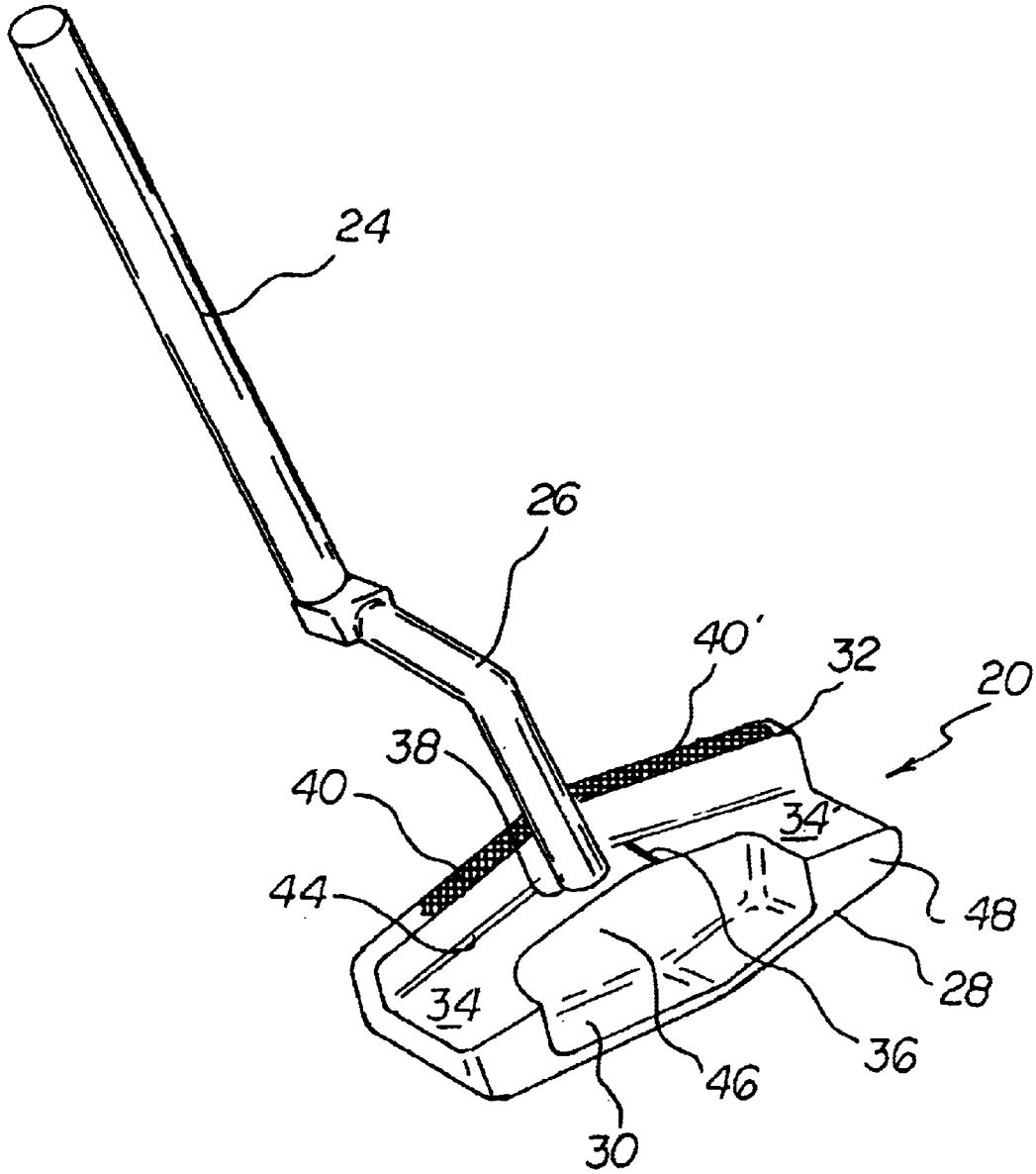
FIG. 3 is an enlarged view of one preferred embodiment of the head of the putter of the invention.

FIG. 3 is an enlarged perspective view, from behind and above, of a head 20 and hosel 26 according to one embodiment of the invention, and in which the primary inventive aspects of the invention reside. The inventive features disclosed in FIG. 3 are typical of alternative embodiments of the invention. Reference to FIG. 3 shows that the head 20 has a conventional sole plate 28 defining the bottom surface of the head 20. The top of the body of the head 20 includes two obliquely intersecting upper surfaces 34,34', defining an obtuse angle therebetween. The line where the two obliquely intersecting upper surfaces 34,34' intersect is a body peak 36 disposed above the center of mass of the body of the head 20. The hosel 26 is inserted into a hosel receiver hole 38 in the body of the head 20. The head 20 has a blade 32, the front face of which is the face contacting the ball during a putt. The top of the blade 32 is the blade edge 40. Important to the advantages of the invention is that the blade edge 40 is elevated above the body of the head 20, particularly above the obliquely intersecting upper surfaces 34,34'. A blade back surface 44 is thus defined and is approximately perpendicular to the top blade edge 40 of the blade 32 and is approximately vertical when the vertical when the blade face is striking the ball during a putt. The blade back surface 44 extends vertically in a first vertical plane.

Also, there is a large concavity in the rear of the head 20, as shown in FIG. 3, which is defined in part by the upper sole plate surface 30 and the body step face 46. The upper sole plate surface 30 is approximately perpendicular to the body step face 46. The body step face 46 is generally parallel to the blade back surface 44, and thus likewise is generally vertical at the instant the blade face strikes the ball during a putt. The body step face 46 extends vertically in a second vertical plane. The rearmost face 48 of the head 20 may be, but need not be, parallel to the body step face 46.

Reference is made to FIGS. 3 and 4A–4C, which show that the head 20 has the blade 32 with the upper blade edge 40 defined by two obliquely intersecting upper surfaces 40,40' which intersect at an obtuse angle to define an aiming ridge 50 on the blade 32. The aiming ridge 50, where the two obliquely intersecting upper surfaces 40,40' intersect, is disposed above the center of mass of the body of the head 20, and is parallel to the body peak 36. Thus, the aiming ridge 50 of the body peak 36 are coplanar, the plane also containing the center mass of the head 20. The aiming ridge 50 defines a right angle with respect to the plane containing the front face 42 of the blade.

Figure 4C:
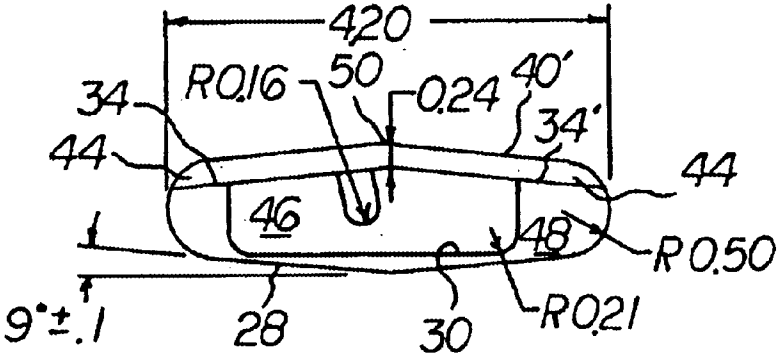
FIG. 4C is a front view of the putter head shown in FIG. 4A.
Figure 4D:
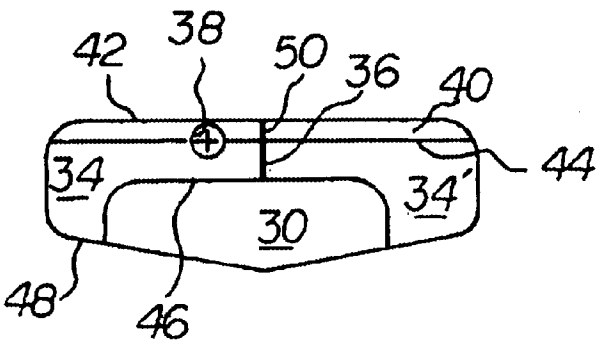
FIG. 4D is a top view of the putter head shown in FIG. 4A, except that an alternative position of the hold for receiving the hosel is shown.
Figure 4A:
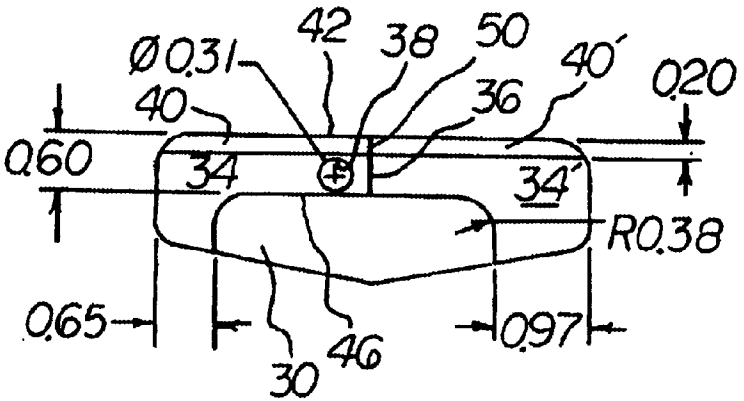
FIG. 4A is a top plan view of an alternative putter head of the invention.
Figure 4B:
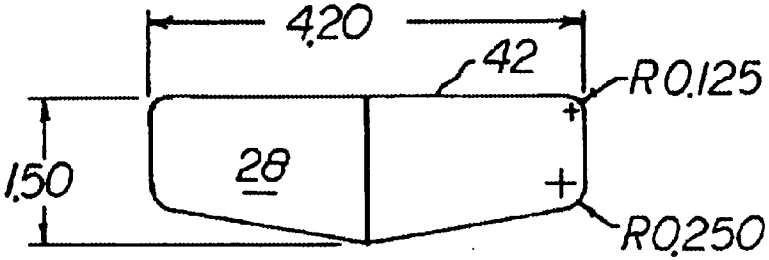
FIG. 4B is a bottom view of the putter head shown in FIG. 4A.
Figure 5A:
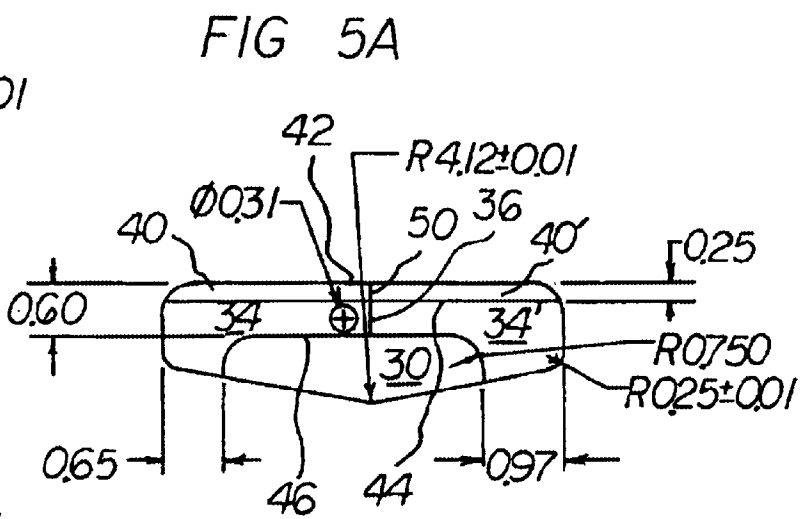
FIG. 5A is a top plan view of another embodiment of the putter head of the invention.
Figure 5B:
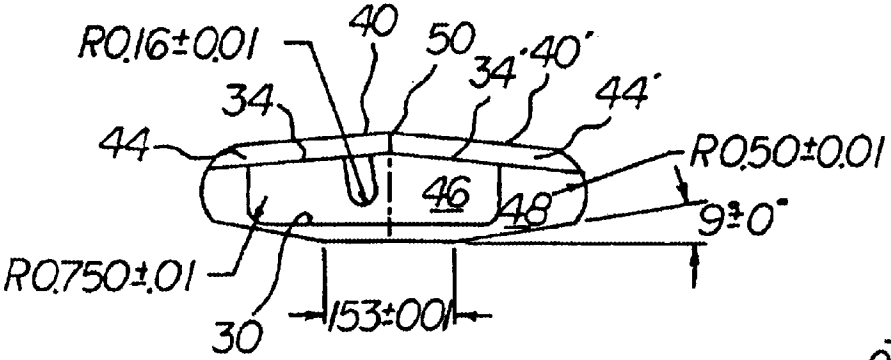
FIG. 5B is a front view of the putter head shown in FIG. 5A.
Figure 5C:
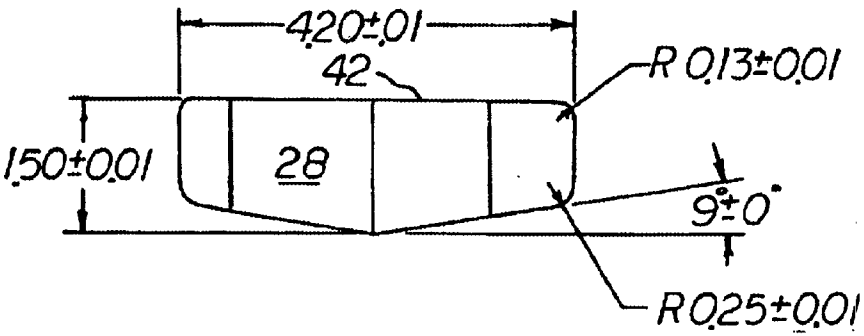
FIG. 5C is a bottom view of the putter head shown in FIG. 5A.
Figure 8C:
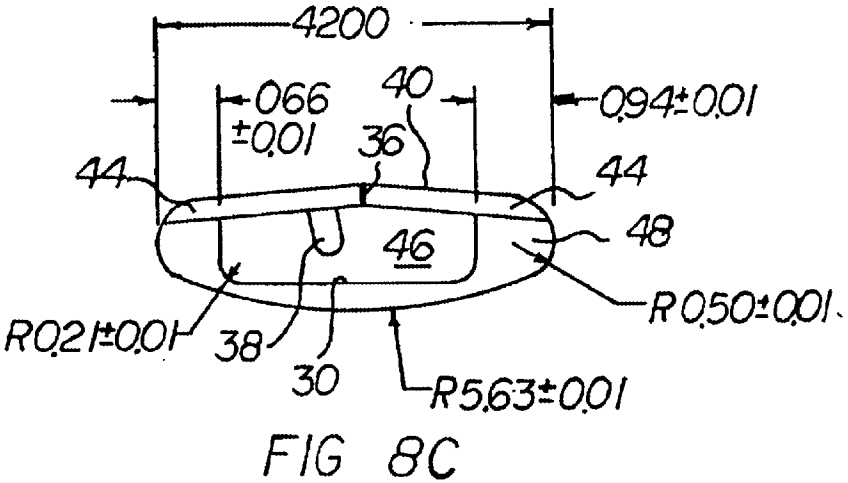
FIG. 8C is a front view of the putter head shown in FIG. 8A.
Figure 8A:
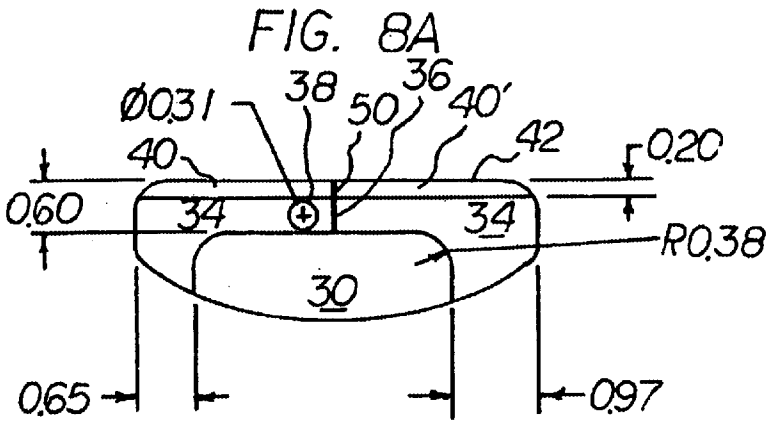
FIG. 8A is a top plan view of yet another embodiment of a putter head of the invention.
Figure 8B:
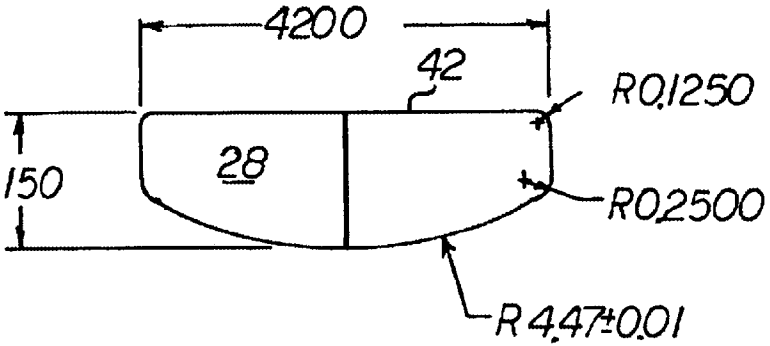
FIG. 8B is a bottom view of the putter head shown in FIG. 8A.
Figure 9C:
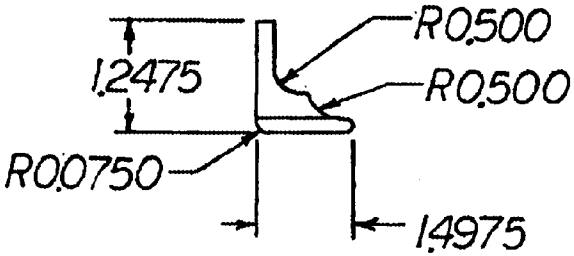
FIG. 9C is a side view of the putter head shown in FIG. 9A.
Figure 9D:
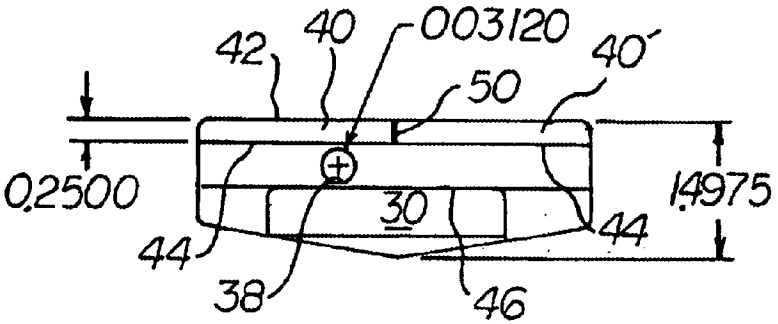
FIG. 9D is a top plan view of the putter head shown in FIG. 9A.
Figure 9A:
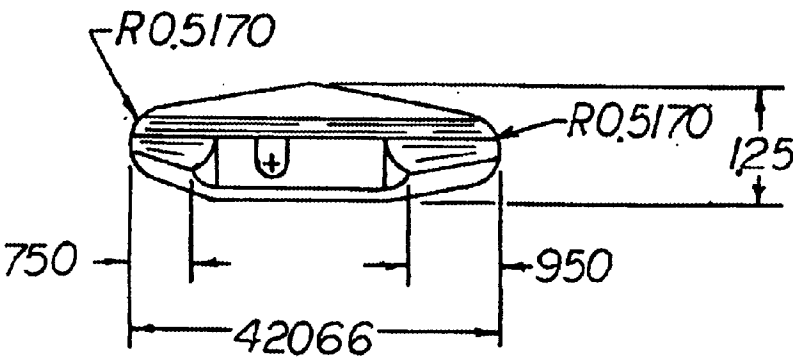
FIG. 9A is a front view of yet another embodiment of a putter head of the invention.
Figure 9B:
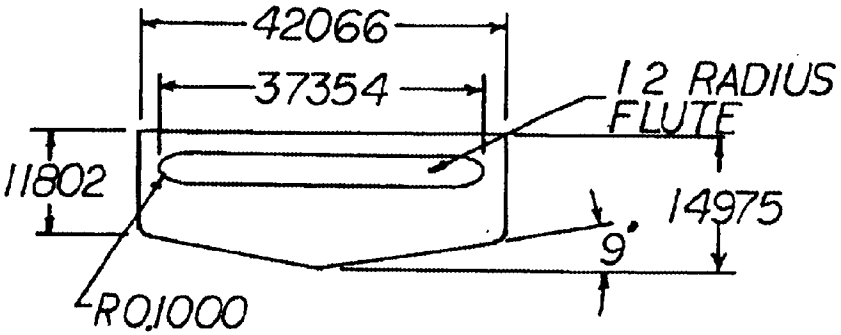
FIG. 9B is a bottom view of the putter head shown in FIG. 9A.
Figure 10C:
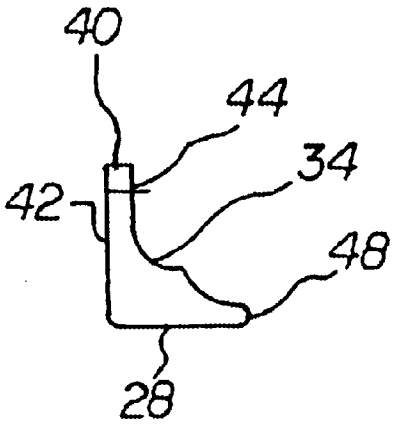
FIG. 10C is a side view of the putter head shown in FIG. 10A.
Figure 10A:
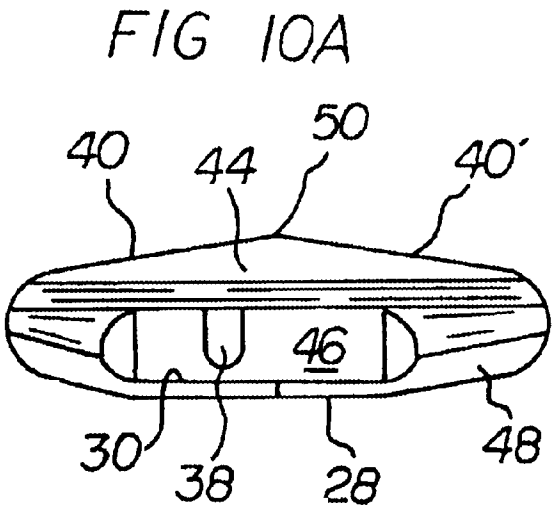
FIG. 10A is a front view of yet another embodiment of a putter head of the invention.
Figure 10B:
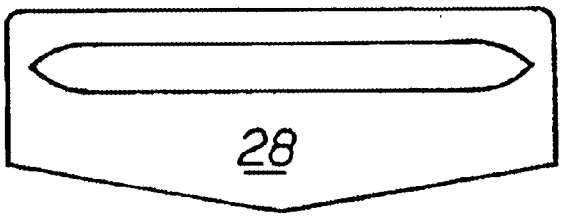
FIG. 10B is a bottom view of the putter head shown in FIG. 10A.

FIGS. 4A–4C thus illustrate principal features of the head 20 which provide the advantages of the invention. More specifically, the blade back surface 44 and the body step face 46, which are mutually parallel and, at the instant when putting contact is made with the ball, are substantially vertical. Also, the body peak 36 and the aiming ridge 50 defined by the obliquely intersecting upper surfaces 34,34' and the obliquely intersecting upper surfaces 40,40', respectively, are used to aim the putting stroke. The use of the aiming ridge 50 to aim the putter is generally in accordance with known aiming devices described above. However, the blade back surface 44 and the body step face 46 are aligning features not previously known.

FIGS. 5A–5C, 8A–8C, 9A–9D, 10A–10C, and 11 serve to illustrate other embodiments of the head 20 of the apparatus of the invention. These alternatives have the same fundamental objects and advantages as the embodiment of FIGS. 4A–4C, and like parts among the various embodiments are denoted with like reference numerals. Notably, the head 20 of the putter of the invention can assume a wide variety of shapes and weights to accommodate user preference. Also, the location of the hosel receiver hole 38 in the head 20 (and thus the point of connection between the hosel 26 and the head 20) can vary considerably along a line extending from the heel to the toe of the head 20 (a line essentially parallel to the blade front face 42), according to user preference. Likewise, the distance between the blade front face 42 and the hosel receiver hole 38 can be varied among different heads.

FIGS. 6A–6C illustrate another preferred form of the hosel 26, an offset hosel. The offset hosel also provides advantages of the invention, because it also features perpendicular surfaces useable to assure proper aiming of the putter club.

FIGS. 7A and 7B are enlarged views of the counterweight 27 shown in FIG. 2A.

FIGS. 12A–12C show lightweight hosel 26 that is not offset. In this respect, the alignment features of the invention can be practiced with non-offset hosel 26 shown in FIGS. 12A–12C.

An advantage of the present invention is the ability, during the construction of a club, to select from an assortment of heads 20, hosels 26, and shafts 24 with keeping with the principles of the invention. During assembly of a putter, a golfer can choose from a variety of different heads (having various weights, loft angles, sole plate configurations, hosel receiver hole positions, and the like), from a variety of different hosels (lightweight, offset, straight, among others), and from a variety of different shafts (having various lengths, weight configurations, and the like).

In a preferred embodiment of the invention, the obliquely intersecting upper surfaces 34,34' may optionally be transected from heel to toe by a mild second body step face 47 (see FIGS. 10A, 11, and 13) parallel to and vertically coplanar with the body step face 46.

Of important note is that the aiming ridge 50 defined by the intersection of the obliquely intersecting upper surfaces 40,40' is elevated with respect to all other surfaces of the head 20 of the club, and thus is closer to the user's eyes during the putt, amplifying its function as an aiming aid. The aiming ridge 50 is used in a known manner, but the present invention provides the aiming ridge 50 in a pronounced position for observation, which is in contrast with above-mentioned painted lines on an unelevated planar top of a conventional putter head.

Referring to the drawings collectively, it is seen that the user is able to properly align the putter by visually aligning the various key aiming surfaces of the head 20. In this respect, the putter of the invention permits a user to observe when the putter is twisted about the longitudinal axis of the putter shaft, or incorrectly tilted with respect to the ground and the ball. In all embodiments of the invention, the golfer pays special attention to the relative positions of the blade back surface 44 and the body step face 46, and the second body step face 47, if provided. When the putter is properly aligned for a putting stroke, the blade back surface 44, the body step face 46, and the second body step face 47 are viewed on their respective edges from the golfer's viewpoint above, and thereby, their respective vertical surfaces are not visible to the golfer and vanish from view. In this respect, an advantage of the present invention is that at least two planes (the blade back surface 44 and the body step face 46) are used for aligning the putter for putting. If the golfer can see either one of the blade back surface 44 or the body step face 46, which would be visible if obliquely positioned in relationship to the golfer's point of view, then the golfer is signalled that the putter is tilted out of proper alignment position for making a straight putting stroke.

Stated somewhat differently, to assure that the golfer can make a straight stroke, in alignment with the ball of the cup, the golfer looks down to the head 20 of the putter while readily observing the aiming ridge 50 and positioning the head 20 to place the aiming ridge 50 collinear with the intended path of the ball, while simultaneously viewing the head 20 to assure that the blade back surface 44 and the body step face 46 remain parallel to the golfer's axis of view and thus essentially non-visible immediately prior to the back swing before making the actual putt. When these conditions are satisfied, in accordance with the invention, the alignment and aim of the putt are significantly improved.

With special reference to the embodiment of the invention shown in FIG. 13, the head 20 and hosel 26 are configured to improve the golfer's putting aim. The hosel 26 of FIG. 13 is also shown in FIGS. 6A–6C and has a planar first hosel side 52, a planar second hosel side 53, and a hosel leg 57. The planar first hosel side 52 is in a third vertical plane, and the planar second hosel side 53 is in a fourth vertical plane. The hosel leg 57 is insertable into the hosel receiver hole 38 in the head 20. The hosel leg 57 has a hosel leg face 58 and a hosel top face 55.

As shown in FIG. 13, as the golfer is poised to putt, the golfer can look down the shaft 24 and focus upon the hosel 26 and the head 20. To properly align the head 20 for putting, the golfer positions the head 20 so that the blade back surface 44 and the body step face 46 and/or second body step face 47 are viewed at their respective edges as discussed above. The blade back surface 44 and the body step face 46 define an alignment channel or region. The hosel 26 has a width approximately equal to the preferably horizontal shelf defined between the blade back surface 44 and the body step face 46 or second body step face 47. To properly align the putter for the stroke, the golfer manipulates the club until the first hosel side 52 and the second hosel side 53 are contained within the above-mentioned alignment channel or region defined by the blade back surface 44 and the body step face 46. Stated differently, the putter is properly aligned for the stroke when the first hosel side 52 and the second hosel side 53 are essentially coplanar with the blade back surface 44 and the body step face 46. With such an alignment, the top side of the hosel 26 is in direct view of the golfer, and the first hosel side 52 and the second hosel side 53 are nearly non-visible from the golfer's point of view. The, the hosel leg face 58 and the hosel top face 55 appear foreshortened by perspective, but will be visible between the blade back surface 44 and the body step face 46, as seen in FIG. 13. If either of the first hosel side 52 or the second hosel side 53 is visible to the golfer, or if either of the planes containing the blade back surface 44 and the body step face 46 is visible along with the hosel top face 55 or the hosel leg face 58, the putter is not optimally aligned for the putting stroke.

When the golfer addresses the ball, in employing the invention, the golfer manipulates the club shaft to place the first hosel side 52 and the second hosel side 53 to be coplanar with the blade back surface 44 and the body step face 46. In this respect, the golfer assures that none of the blade back surface 44, the body step face 46, the first hosel side 52, and the second hosel side 53 are oblique to the axis of view of the golfer. In this way, none of the blade back surface 44, the body step face 46, the first hosel side 52, and the second hosel side 53 are viewable to the golfer. With this alignment, the blade back surface 44 and the body step face 46 are approximately vertical when the blade front face 42 of the head 20 is at the point of contact with the ball. Simultaneously, the aiming ridge 50, which defines a right angle with the blade back surface 44 and the body step face 46, is viewed to align it with the center of the ball and the intended path of the ball. When these conditions are satisfied, the back swing of the putt is commenced with greater confidence in aiming accuracy.

Figure 14:
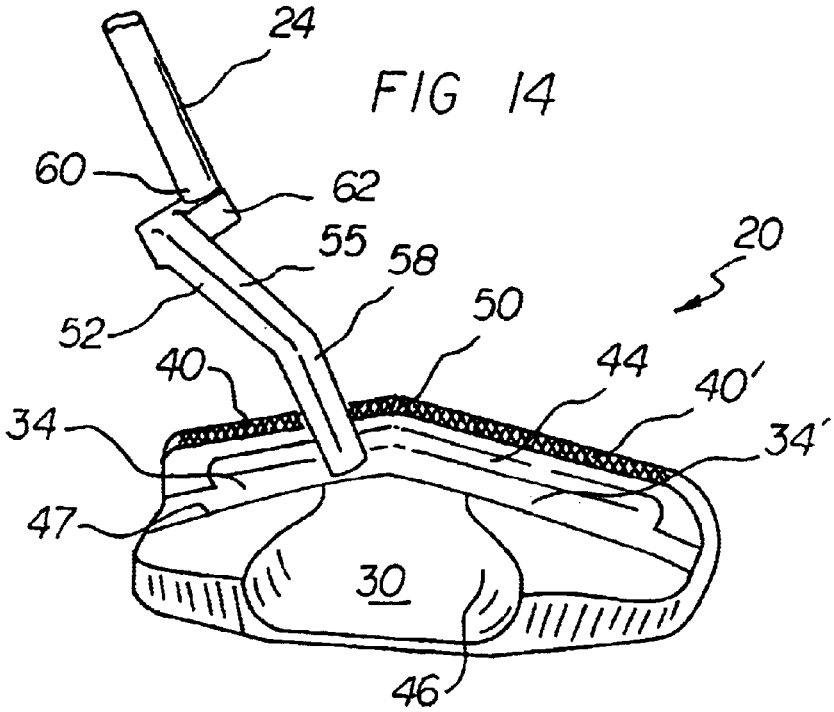
FIG. 14 is an enlarged perspective view of the apparatus of the invention, incorporating an alternative, offset hosel.
Figure 15:
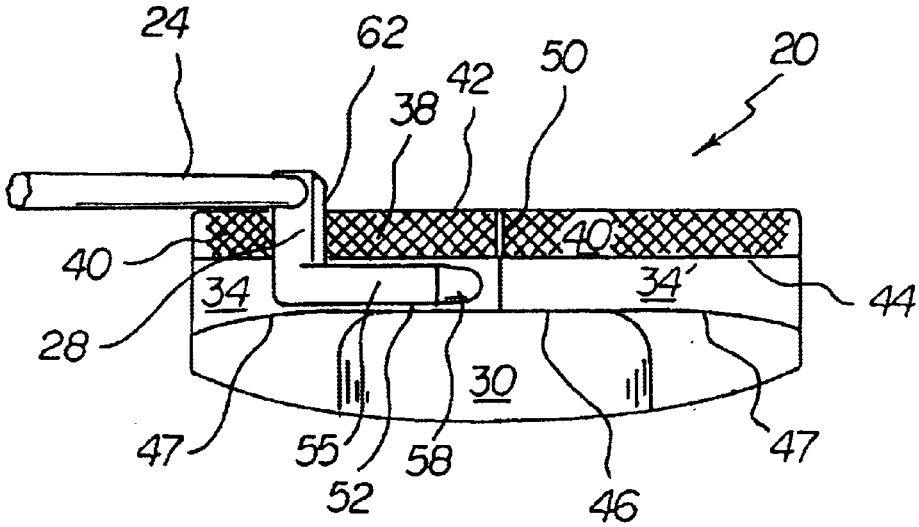
FIG. 15 is a top view of a putter head, offset hosel, and handle shaft, depicting alignment features of the invention.

FIGS. 14 and 15 illustrate an alternative embodiment of the invention incorporating an offset hosel having an offset hosel portion 60, and also having the first hosel side 52 and the second hosel side 53. The first hosel side 52 and the second hosel side 53 serve the same purposes and functions as described above for other embodiments of the invention. When the apparatus is in use, the golfer looking down the shaft 24 has a similar view to that seen in FIG. 15. When the first hosel side 52 and the second hosel side 53 are effectively invisible but aligned with the blade back surface 44 and the body step face 46, the golfer has increased confidence in the accuracy of the alignment.

An additional advantage is provided by the offset hosel portion 60. The offset hosel portion 60 has a hosel leading face 62 that provides still an additional advantage to an embodiment of the invention having a straight hosel 26. More specifically, the offset hosel portion 60 defines an optical right angle with the blade front face 42 as well as the blade back surface 44.

In this respect, the offset hosel embodiment of the invention presents the added advantage of offering a second set of visual planes for use in optimizing the alignment during the putting stroke. However, this second set of planes are oriented at ninety degree angles, rather than parallel, when the putter is properly aligned. To align the putter, the golfer addresses the ball by manipulating the shaft 24 and the head 20 so that the second hosel side 53 of the offset hosel portion 60 is coplanar with the blade back surface 44, and the first hosel side 52 is coplanar with the body step face 46 (i.e. placing the hosel in the above described alignment channel or region). Then, additionally, the putter is further manipulated, while maintaining the alignment of the first hosel side 52 and the second hosel side 53 with the blade back surface 44 and the body step face 46, so that the hosel leading face 62 is perceived to be at a right angle with the blade front face 42 and the blade back surface 44. With the respective surfaces aligned as described, the golfer aligns the aiming ridge 50 with the center of the golf ball in anticipation of the putting stroke. Furthermore, the forward offset allows a desirable "hands through first" concept, in combination with the hosel alignment features.

The components of the putter golf club with alignment features of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved putter golf club with alignment features that is low in cost, relatively simple in design and operation, and which may advantageously be used to have an extended alignment line. With the invention, a putter golf club with alignment features is provided which includes means for assuring that the putter is not improperly tilted when a putter is employed. With the invention, a putter golf club with alignment features provides a system of interchangeable putter golf club components can be used to accommodate a wide variety of golfers. With the invention, a putter golf club with alignment features provides a system which employs interchangeable putter golf club handles, counterweights, hosels, and heads to accommodate a wide variety of golfers, including golfers who grow up from junior golfers to senior golfers.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A putter golf club apparatus, comprising:

a handle shaft, a head connected to said handle shaft, wherein said head includes a front face and a back face, a front blade which encompasses said front face and includes a blade back surface which extends vertically in a first vertical plane, an upper surface located behind said blade back surface and having a vertical height lower than said blade back surface, and a body step defining a body step face located behind a portion of said upper surface at a predetermined distance away from said blade back surface, wherein said body step face extends vertically in a second vertical plane and said body step opens into said back face of said head, said first vertical plane and said second vertical plane being parallel to each other, wherein said predetermined distance between said blade back surface and said body step face defines an alignment region located between said blade back surface and said body step opening into said back face of said head, and wherein said alignment region is further characterized by a pair of obliquely intersecting upper surface portions having a vertical height lower than said blade back surface, wherein said obliquely intersecting upper surface portions intersect at a body peak which forms an alignment line that is perpendicular to said blade back surface and said body step face, said apparatus further including:

a hosel connected between said handle shaft and said head, wherein said hosel includes:

a planar first hosel side which is in a third vertical plane, and a planar second hosel side which is in a fourth vertical plane, wherein said planar first hosel side and said planar second hosel side are connected to said head in said alignment region proximal to said body peak, wherein said planar first hosel side and said planar second hosel side are viewable within said alignment region extending substantially parallel to and between said first vertical plane and said second vertical plane and in alignment with one of said obliquely intersecting upper surface portions when said hosel is aligned with said head from above to properly align said head of said apparatus with a golf ball prior to putting said golf ball therewith.

2. The apparatus of claim 1 wherein said blade includes obliquely intersecting upper surface portions which intersect at an aiming ridge, wherein said aiming ridge is colinear with said body peak.

3. The apparatus of claim 1 wherein said hosel includes an offset hosel portion which is perpendicular to said first hosel side and said second hosel side.

4. The apparatus of claim 1 wherein said handle shaft includes a counterweight received in a hollow portion of said handle shaft.

* * * * *